US005929370A

United States Patent [19]

Brown et al.

[11] Patent Number: 5,929,370

[45] Date of Patent: Jul. 27, 1999

[54] AERODYNAMICALLY STABILIZED PROJECTILE SYSTEM FOR USE AGAINST UNDERWATER OBJECTS

[75] Inventors: Jeffrey A. Brown, Placentia, Calif.; Reed Copsey, Port Angeles, Wash.; Marshall Tulin, Santa Barbara, Calif.; Roy Kline, Newton, N.J.

[73] Assignee: Raytheon Company, Lexington, Mass.

[21] Appl. No.: 08/993,544

[22] Filed: Dec. 18, 1997

Related U.S. Application Data

[63] Continuation of application No. 08/474,425, Jun. 7, 1995, abandoned.

[51] Int. Cl.[6] ..... F42B 15/20; F42B 15/22; F42B 5/24

[52] U.S. Cl. ..... 102/399; 102/398; 102/501

[58] Field of Search ..... 102/382, 390, 102/398, 399, 501, 503, 506, 518, 519, 520, 521; 114/20.1, 22, 23; 244/3.1, 3.3

[56] References Cited

U.S. PATENT DOCUMENTS

| | | | |
|---|---|---|---|
| H58 | 5/1986 | Smith et al. | 102/501 |
| H700 | 11/1989 | Farinacci | 102/501 |
| 298,455 | 5/1884 | Ericsson | 102/399 |
| 1,294,604 | 2/1919 | Berentsen | 102/399 |
| 1,327,531 | 1/1920 | Durham | 102/399 |
| 3,002,453 | 10/1961 | Fedor et al. | 102/399 |
| 3,041,992 | 7/1962 | Lee | 114/20.1 |
| 3,088,403 | 5/1963 | Bartling et al. | 102/399 |
| 3,110,262 | 11/1963 | West | 102/399 |
| 3,282,216 | 11/1966 | Calfee et al. | 244/3.3 |
| 3,313,499 | 4/1967 | Ohman | 244/3.3 |
| 3,434,425 | 3/1969 | Critcher | 102/399 |
| 3,442,205 | 5/1969 | Stadler et al. | 102/503 |
| 3,447,376 | 6/1969 | Nelson et al. | 102/399 |
| 3,759,184 | 9/1973 | Blajda et al. | 102/520 |
| 3,915,092 | 10/1975 | Monson et al. | 102/399 |
| 4,043,269 | 8/1977 | Ambrosini | 102/501 |
| 4,126,955 | 11/1978 | Coffield, Jr. et al. | 102/520 |
| 4,165,692 | 8/1979 | Dufort | 102/501 |
| 4,353,302 | 10/1982 | Strandli et al. | 102/518 |
| 4,469,027 | 9/1984 | Burns et al. | 102/521 |
| 4,534,294 | 8/1985 | Von Laar et al. | 102/520 |
| 4,616,568 | 10/1986 | Serge | 102/501 |
| 4,669,386 | 6/1987 | Precoul et al. | 102/501 |
| 4,732,086 | 3/1988 | Schiestl et al. | 102/521 |
| 4,735,147 | 4/1988 | Halverson | 102/520 |
| 4,736,686 | 4/1988 | Martin | 102/519 |
| 4,788,914 | 12/1988 | Frater | 102/399 |
| 5,016,538 | 5/1991 | Sowash | 102/520 |
| 5,063,854 | 11/1991 | Bisping et al. | 102/520 |
| 5,069,138 | 12/1991 | Ekbom | 102/518 |
| 5,088,416 | 2/1992 | Sabranski | 102/521 |
| 5,347,907 | 9/1994 | Strandli et al. | 102/519 |
| 5,464,173 | 11/1995 | Sharrow et al. | 244/3.3 |

*Primary Examiner*—Charles T. Jordan
*Assistant Examiner*—Theresa M. Wesson
*Attorney, Agent, or Firm*—Colin M. Raufer; Leonard A. Alkov; Glenn H. Lenzen, Jr.

[57] ABSTRACT

A projectile is propelled from a location in air, through an air/water interface, and toward a submerged underwater object. The projectile includes a forward end that forms a cavitation void around the projectile in water, avoiding water drag on the remainder of the projectile. The projectile further includes an outwardly flared or finned rearward end that aerodynamically stabilizes the projectile in air and flare stabilizes it in water, in each case against yaw.

20 Claims, 4 Drawing Sheets

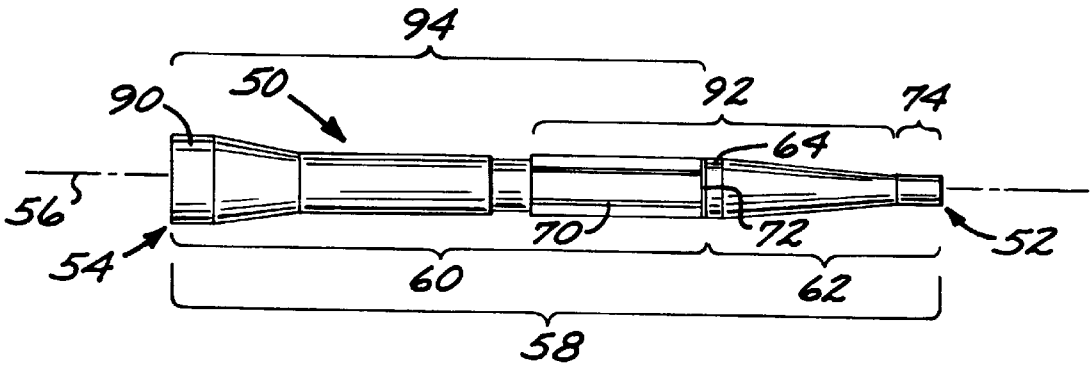
FIG. 2
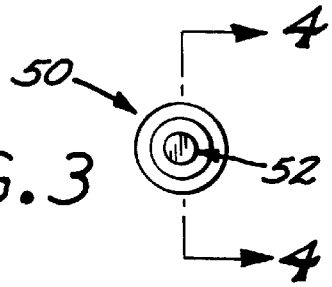
FIG. 3
FIG. 4
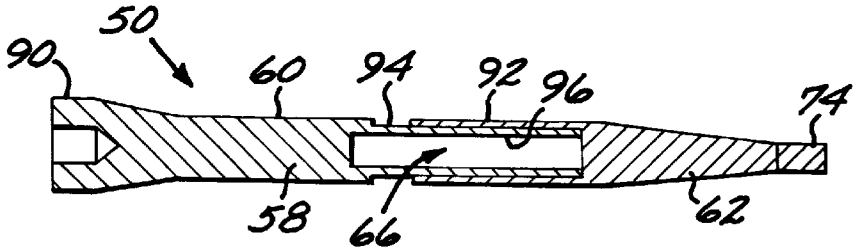
FIG. 5
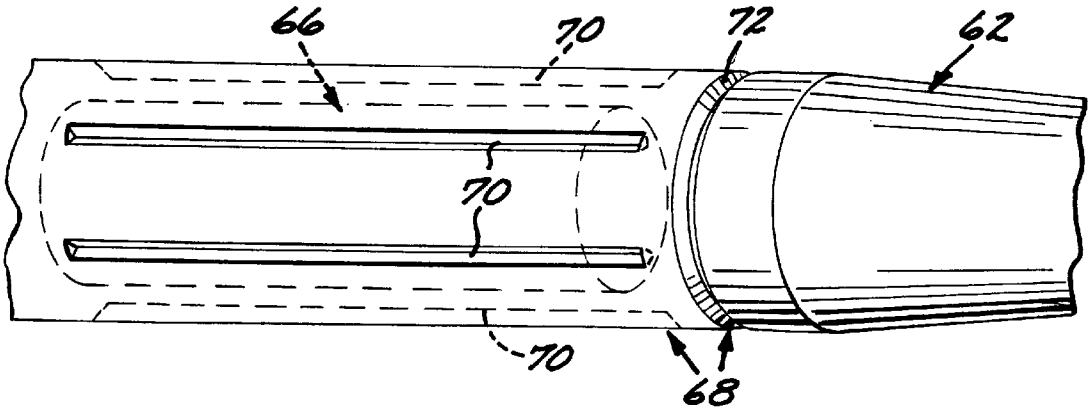

AERODYNAMICALLY STABILIZED PROJECTILE SYSTEM FOR USE AGAINST UNDERWATER OBJECTS

This patent is a continuation of patent application Ser. No. 08/474,425, filed Jun. 7, 1995, now abandoned.

BACKGROUND OF THE INVENTION

This invention relates to munitions, and, more particularly, to a projectile system that can be fired from air against underwater objects located at moderate underwater ranges.

Projectiles are widely used against targets in air. In the most common approach, the projectile is placed into a gun, together with a propellant. The propellant is ignited, driving the projectile out of the barrel of the gun and toward the target.

Projectiles have extremely limited capability to be fired from air against targets in water, primarily for three reasons. First, the trajectory of the projectile can be radically altered when it encounters the interface between the air and the water (i.e., the surface of the water). At a shallow angle of incidence to the water, the projectile may not enter the water at all, and instead may skip away. At a higher angle of incidence to the water, the projectile may enter the water but its path is altered. This problem is always a consideration, but it is of particular concern to the accuracy of the projectile when the surface of the water exhibits a constantly varying state due to wave motion. Second, the drag produced by the water rapidly slows the projectile and drastically limits its range. The range of conventional projectiles in water varies according to the weight and initial velocity of the projectile, but is typically at most no more than about 3 feet under optimal conditions for a conventional 20 millimeter projectile. Third, the lateral hydrodynamic forces on the projectile can cause it to tumble, further limiting its range and effectiveness.

For these reasons, projectiles are seldom fired from air against targets submerged in water. If conventional projectiles are fired from air toward a target submerged in water, they are largely ineffective. Instead, self-propelled devices such as torpedoes are used, and even in this case the torpedo is usually dropped into the water before its propulsion is started.

There are applications where a projectile that can be fired against underwater targets from the air would be useful. For example, a standard defense against amphibious military operations is underwater mines placed at moderate depths in near-shore landing areas. Such mines are now removed by specially trained swimmers at considerable risk or robotic devices which have significant constraints in their operation. An alternative approach would be to fire a projectile at the underwater mine from the air, as from a helicopter. Projectiles are far less costly than self-propelled devices in such applications, and could be made of different sizes and types for firing from a range of weapons of both small and large bores.

Thus, there is a need for a projectile that can be fired from air against underwater targets. The present invention fulfills this need, and further provides related advantages.

SUMMARY OF THE INVENTION

The present invention provides a projectile system and a method for its use. The projectile system is fired from air against submerged underwater objects, passing through the air/water interface on its way to the target. The projectile can pass through the air/water interface with little or no deflection, regardless of the angle of incidence of the projectile. The projectile is relatively inexpensive, and can be produced for a variety of both conventional and unconventional weapons of various bores.

In accordance with the invention, a projectile system comprises a projectile, which includes a generally cylindrically symmetric projectile body with a projectile body forward end and a projectile body rearward end. The projectile includes means for forming a cavitation void around the projectile body when the projectile body is passed through water, located at the projectile body forward end. The projectile further includes means for stabilizing the projectile body against lateral instability, joined to the projectile body adjacent to the projectile body rearward end.

The means for stabilizing is preferably a radially outwardly flared region at the rearward end of the projectile body, or a set of fins located symmetrically around the circumference of the projectile. The fins can be rigid or folding, so that the fins are folded before the projectile is fired and unfolded in flight. The flare or fins provide aerodynamic stabilization of the projectile in air.

When the projectile is in water, a cavitation void is formed around the sides and rear of the projectile. The cavitation void is a substantially liquid-free volume extending radially outwardly and rearwardly from the wetted forward end of the projectile. This volume, filled only with air and water vapor, exerts little drag and/or lateral force on the body of the projectile. Consequently, the projectile can travel for moderately large distances through water. If, as the projectile enters or travels through water, it experiences lateral instability so that the cylindrical axis of the projectile does not coincide with its trajectory (flight path), the stabilizing means interacts with the surface of the cavitation void and exerts a restoring force that tends to bring the cylindrical axis of the projectile back into coincidence with the trajectory. Absent such a restoring force, the projectile would quickly deviate from its trajectory and begin tumbling.

In a preferred embodiment, a projectile system comprises a generally cylindrically symmetric projectile with a projectile forward end and a projectile rearward end. The projectile has a stinger head at the projectile forward end. The stinger head includes a stinger nose having a nose maximum diameter and a stinger body having a stinger body forward end joined to a rearward end of the stinger nose. The stinger body includes a stinger nose support having a nose support diameter, and a flow separation groove between the stinger nose support and the stinger nose. The flow separation groove has a groove diameter less than the nose maximum diameter. The projectile further includes a generally cylindrically symmetric projectile body joined to the stinger head, including a projectile afterbody having a projectile afterbody diameter greater than the nose support maximum diameter, and a projectile forebody joined to the stinger nose support at a forward end and to the projectile afterbody at a rearward end. There is a means for stabilizing the projectile against lateral instability, joined to the projectile body at the rearward end of the projectile body, as discussed previously.

As used herein, a "projectile" is an object that is propelled by an external force, and which has no capacity for self propulsion. Thus, in this use, a bullet mounted to a canister of propellant that remains in a gun after the bullet is fired is a projectile because the bullet itself has no self-propulsion capability. For example, aircraft, rockets, and torpedoes that have a built-in engine and carry their own fuel are not projectile. The present invention relates to a projectile and a system for its utilization, not to a self-propelled device.

Because of its varying diameters along the length of the projectile, the projectile system can further include a discardable sabot that initially fits around the projectile and creates a uniform diameter that fits smoothly in the bore of a firing weapon. After the projectile system is fired, the sabot falls away and the projectile travels along its trajectory to the target.

The present invention provides an important advance in the art of projectile systems. The projectile of the invention can be fired from air effectively against an underwater target. In the air, the projectile is stabilized along a straight trajectory. The projectile passes through the air/water interface with little deflection, for a wide range of angles of incidence. In water, the trajectory is maintained and there is a moderate underwater range. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 2 is a side elevational view of one embodiment of the projectile;

FIG. 3 is a forward-end elevational view of the projectile of FIG. 2;

FIG. 4 is a sectional view of the projectile of FIGS. 2 and 3, taken generally along line 4—4 of FIG. 3;

FIG. 5 is a schematic detail of FIG. 2, illustrating the projectile afterbody;

DETAILED DESCRIPTION OF THE INVENTION

Figure 1:
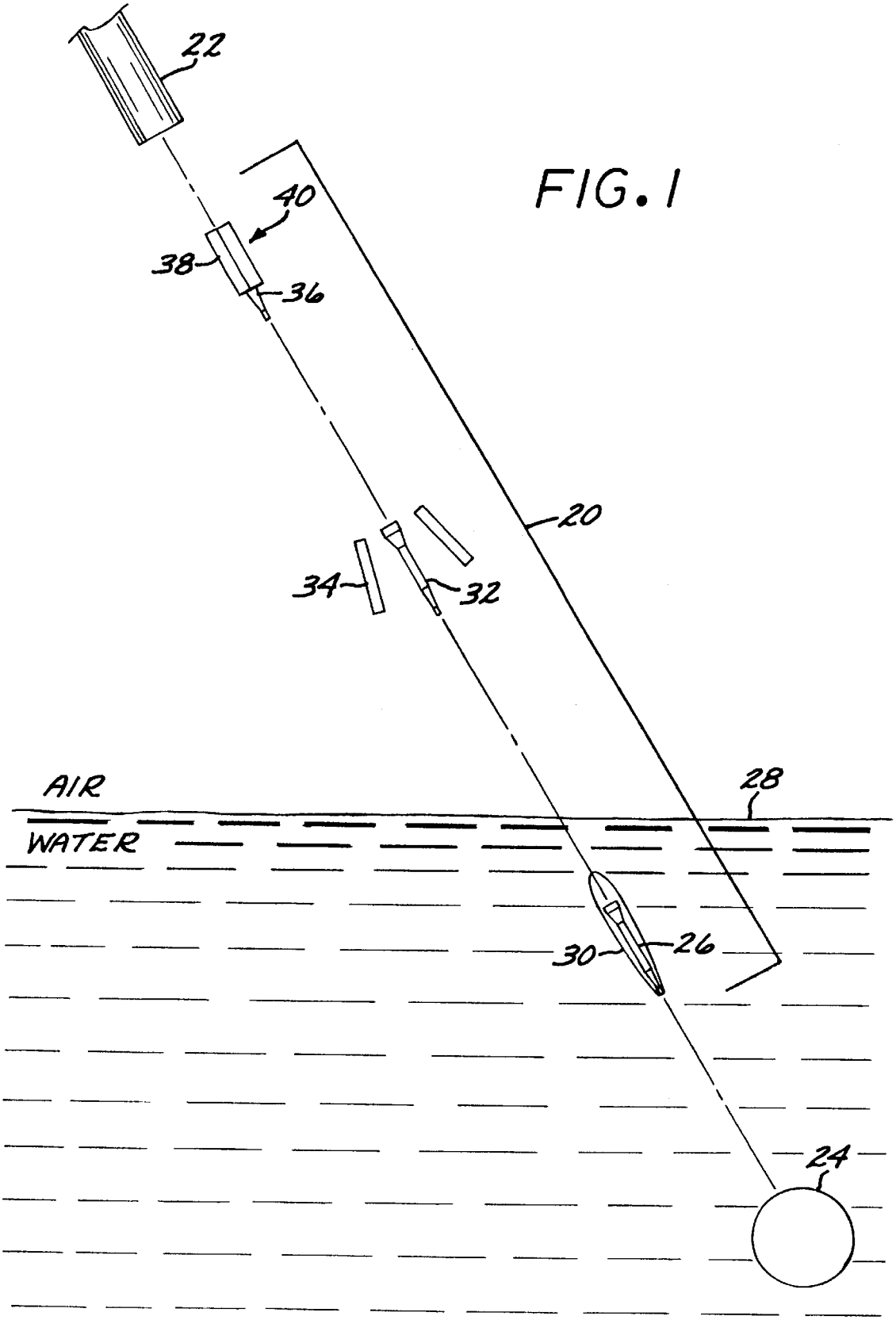
FIG. 1 is a schematic drawing of a series of projectiles being fired from air toward a target submerged in the water.

FIG. 1 depicts a series 20 of projectiles being propelled from a barrel of a gun 22, which is located in air, toward a target 24, which is immersed in water. The first-fired projectile 26 has passed through an air/water interface 28 and is surrounded by water. The first-fired projectile 26 resides within a cavitation void 30, so that the surrounding water does not actually touch the first-fired projectile 26, except at its wetted forwardmost end. A second-fired projectile 32 is still travelling along its trajectory in air. Pieces 34 of a sabot have separated from the second-fired projectile 32 shortly after the second-fired projectile 32 has left the gun 22. A third-fired projectile 36 has a sabot 38 still positioned around the projectile, prior to its separation. The projectile 36 and sabot 38 together constitute one form of a projectile system 40.

FIG. 2 illustrates one embodiment of a projectile 50 in side elevation, and FIG. 3 shows the front elevation of the same projectile. The projectile 50 is generally cylindrically symmetric with a forward end 52 and a rearward end 54. As used herein, "generally cylindrically symmetric" means that the body is cylindrically symmetric about a cylindrical axis 56, except that there may be discrete features such as fragmentation grooves, fins, or flares which are spaced around the circumference of the body.

The majority of the length of the projectile 50 is a projectile body 58. The projectile body 58 includes a generally cylindrically symmetric projectile afterbody 60 that occupies approximately the rearmost half of the projectile body 58. The projectile body 58 also includes a generally cylindrically symmetric projectile forebody 62 whose rearward end 64 is contiguous with the projectile afterbody 60. In the projectile body 58, the projectile forebody 62 is in the shape of a frustum of a cone. The projectile body 58, or at least a portion thereof such as the forebody 62, is preferably formed of a dense penetrator material such as tungsten.

The projectile body 58 may optionally be hollow to contain a payload cavity 66, shown in FIG. 4. The payload cavity 66 contains a reactive chemical such as lithium perchlorate oxidizer or an explosive. To promote fragmentation of the projectile body 58 upon impact with the target 24 and subsequent dispersal of the contents of the payload cavity 66, a pattern of fragmentation grooves 68 is desirably formed on an outer surface of the projectile body 58, as shown in FIG. 5. The fragmentation grooves 68 include longitudinal grooves 70 extending parallel to the cylindrical axis 56 and one or more circumferential grooves 72 extending around the circumference of the payload body 58.

The fragmentation grooves 68 interact by imposing a fragmentation force on the projectile body 58 that is unique to the event of impact with the target 24 and is not experienced as the projectile enters the water or elsewhere. As the projectile forebody 62 penetrates the target, the outer portion of the projectile forebody 62 is pushed rearwardly toward the fragmentation grooves 68. The force imposed on the circumferential groove 72 causes the skin of the afterbody 60 to begin to crumple and fragment. The longitudinal grooves 70 aid in propagating the crumpling along the length of the projectile afterbody 60. This relative movement leads to a fragmentation of the outer casing of the projectile afterbody 60 and exposure and dispersal of the contents of the payload cavity 66.

A structure that forms the cavitation void 30 around the projectile 50 when the projectile 50 travels rapidly through water is located at the forward end 52 of the projectile 50. This structure passes through the water such that the water does not flow along the projectile body 58. Instead, the water is forced in a transverse direction such that it does not contact and wet the sides of the projectile body 58. Only the cavitation-producing structure contacts and is wetted by the water. The cavitation void 30 is a partial vacuum that may contain some air and water vapor.

Figure 6:
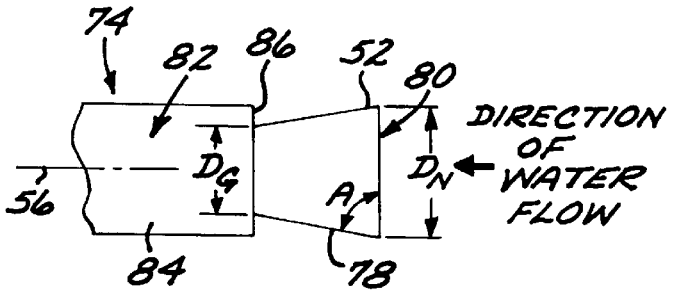
FIG. 6 is a detail of FIG. 2, illustrating the stinger head.

FIG. 6 illustrates a preferred form of the cavitation-producing structure, a stinger head 74. The stinger head 74 is cylindrically symmetric about the cylindrical axis 56 and is affixed to a projectile body forward end 76. The stinger head 74 includes a forwardmost stinger nose 78. In this embodiment, the stinger nose 78 includes a flat, blunt forward face 80 with a nose maximum diameter $D_N$. This forward face 80 is preferably very smooth, with a surface roughness of no more than about 16 microinches. Rearwardly of the forward face 80, the stinger nose 78 tapers radially inwardly at an angle A, which is preferably about 80°, relative to the forward face 80.

The stinger nose 78 is supported on a stinger body 82, which in turn is affixed to the projectile body forward end 76. The stinger body 82 includes a cylindrical stinger nose support 84 and a circumferential flow separation groove 86 between the stinger nose support 84 and the stinger nose 78. In the illustrated preferred embodiment, the flow separation groove 86 may alternatively be viewed as a forwardly facing shoulder between the stinger nose support 84 and the stinger nose 78. A diameter $D_G$ of the flow separation groove 86 is less than the diameter $D_N$ of the forward face 80 of the stinger nose 78.

The stinger head 74 is preferably made of a hard material such as high speed steel, tungsten carbide, or tungsten alloy to resist impact with the water. The stinger head 74 impacts the water at velocities as high as 3000–4000 feet per second, which imposes a loading of about 50 kilobars on the stinger head in a period of about 0.1 microsecond. The stinger nose 78 portion of the stinger head 74 should be very smooth to promote a thin boundary layer dimension. Testing has shown that the stinger nose 78 should have a surface roughness of no greater than about 16 microinches in order to achieve the desired boundary layer dimension during the travel of the projectile through the water.

Figure 7:
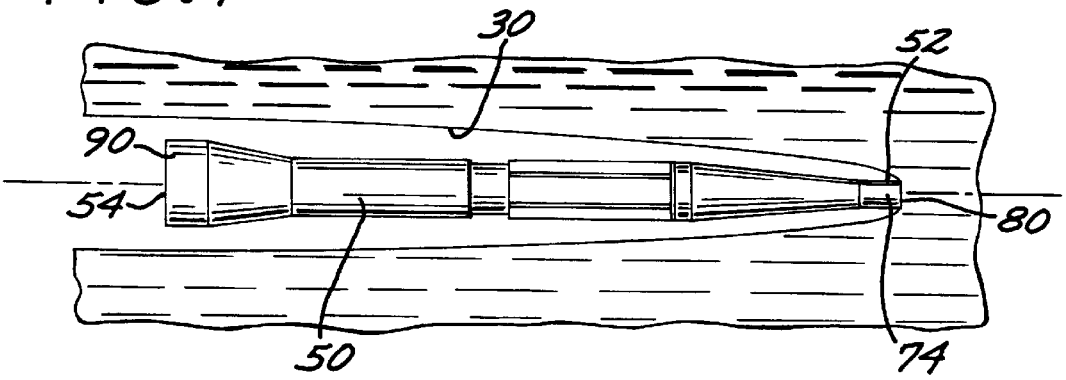
FIG. 7 is a schematic view of the projectile as it travels on a straight trajectory through water.

As the projectile 50 passes through the water at a high velocity, a water flow boundary layer is produced at the stinger nose 78. The water flow boundary layer adheres to the surface of the stinger nose 78. Along the sides of the stinger nose 78, the inwardly tapered shape of the stinger nose 78 cooperates with the flow separation groove 86 to cause an intended flow separation of the water from the projectile 50 as the projectile 50 passes through the water. As shown in FIG. 7, this flow separation creates the cavitation void 30. Thus, only the forwardly facing surface 80 of the stinger nose 78 portion of the projectile 50 contacts the water, and the remainder of the projectile 50 is not wetted. The pressure and skin drag on the projectile 50 are therefore minimal, resulting in greatly extended underwater range of the projectile as compared with conventional projectiles. Hydrodynamic effects on the projectile that potentially cause trajectory deviations are also reduced. The stinger nose 78 is not optimally streamlined for passage through the air, but because of its small diameter the added air resistance is not significant and the projectile 50 is capable of supersonic flight through air.

Nevertheless, there may be lateral forces applied to the projectile 50 as it enters the water at the air-water interface 28 or as it travels through the water. In normal movement of the projectile 50, the trajectory of the projectile is stabilized. When lateral instability occurs in the absence of a lateral stabilizing means such as discussed next, the rearward end 54 moves laterally relative to the forward end 52. The side of the projectile contacts the wall of the cavitation void 30, wetting the side of the projectile. In this event, a tumbling motion of the projectile 50 is induced, leading to increased water drag, collapse of the cavitation void 30, and a rapid slowing of the projectile 50.

To counteract lateral instability, a means for stabilizing the projectile against lateral instability is provided on the projectile body 58. As its stabilization means, the projectile 50 includes a radially outwardly flared enlargement 90 positioned adjacent to the rearward end 54 of the projectile, as seen in FIGS. 2, 4, 7, and 8. This radially outwardly flared enlargement 90 is formed by making the diameter of the projectile afterbody 60 larger at the rearward end 54 larger than at more forward locations.

Figure 8:
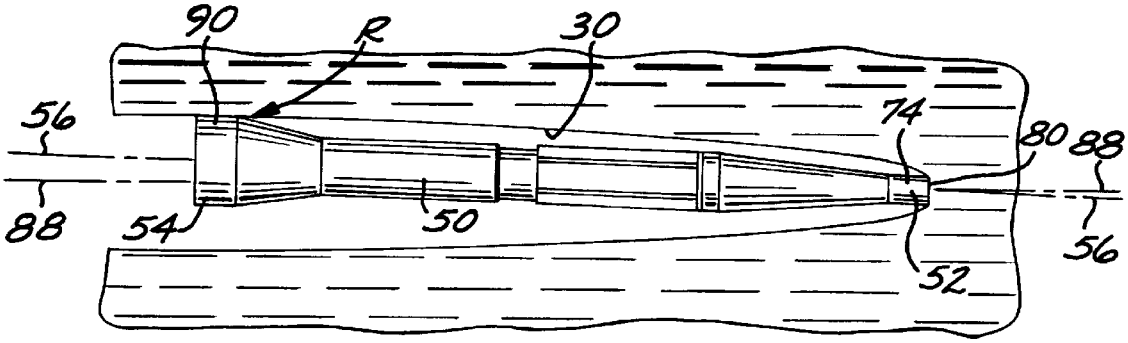
FIG. 8 is a schematic view similar to that of FIG. 7, except that the projectile has experienced a lateral instability.

The radially flared enlargement 90 functions in the manner shown in FIG. 8. If the rearward end 54 of the projectile 50 yaws into the wall of the cavitation cavity 30, the radially flared enlargement 90 is brought into contact with the envelope of the cavitation void 30' see arrow R in FIG. 8. Water pressure against the radially flared enlargement 90 creates a restoring force that pushes the cylindrical axis 56 of the projectile 50 back toward coincidence with its trajectory 88.

The use of the radially flared enlargement 90 has the advantage of providing a long moment arm to the center of gravity of the projectile 50. This long moment arm is effective in generating a stabilizing force to return the projectile 50 to the center of the cavitation void 30 and its stable trajectory 88. It has the disadvantage of increasing the outer diameter of the projectile 50 and adding mass at the rear of the projectile 50 rather than further forward as is desirable.

The projectile 50 is desirably manufactured in three pieces shown in FIGS. 2 and 4: the stinger head 74, a forebody unit 92, and an afterbody unit 94, which are thereafter assembled as the final projectile 50. The forward end of the afterbody unit 94 has a reduced-diameter region 96 that slides into the rearward end of the forebody unit 92, defining the payload cavity 66. This approach allows the stinger head 74 to be made of a hard, erosion-resistant, and impact-resistant material such as high speed steel, tungsten carbide, or tungsten alloy. The stinger head 74 can be machined to an extremely smooth finish. The projectile forebody unit 92 is made of a soft, dense material such as tungsten, to provide mass and to reduce wear on the inside of the gun barrel. The projectile afterbody unit 94 is made of a soft, less dense material such as brass or copper, to reduce the mass at the rear of the projectile.

Figure 9:
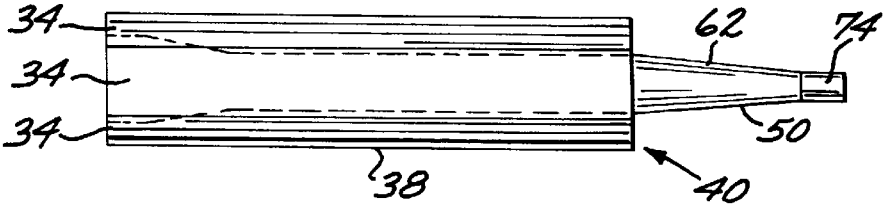
FIG. 9 is a schematic view of a projectile with a sabot.

The projectile 50 is initially furnished encased within the sabot 38, as shown in FIG. 9. The sabot 38 is a sectional housing formed of a plurality of the pieces 34 that fit over the projectile body 58, permitting the projectile forebody 62 and the stinger head 74 to extend therefrom. The sabot 38 is made of a relatively soft material such as nylon 612, which, unlike the metallic and hard materials that comprise the projectile body 58, does not unduly wear the interior walls of the barrel of the gun 22 as the projectile system 40 is fired therefrom. The projectile system 40 is loaded into a cartridge that also contains gunpowder and a primer behind the sabot, in the manner of a conventional bullet. This assembly is loaded into the gun 22, the charge of powder is ignited, and the projectile system travels the length of the barrel and out of the gun. The aerodynamically stabilized projectile 50 of the invention is preferably fired from an unrifled barrel, so that there is no spinning of the sabot 38 and thence the projectile system 40 as it leaves the barrel. Initially upon leaving the gun 22, the sabot 38 remains in contact with the projectile 50' see projectile 36 of FIG. 1. After a brief time, the sabot pieces 34 separate from the projectile under the influence of the imposed aerodynamic forces, as seen for the projectile 32 of FIG. 1. The sabot pieces 34 are thus discarded, and the projectile travels along its trajectory toward the target.

The projectile 50 preferably has a length-to-diameter ratio (L/D) of greater than 4:1, and is preferably from about 4:1 to about 8:1. For smaller values of L/D, the restoring force moment arm is insufficient to counteract lateral instability and there is insufficient mass in the projectile for satisfactory penetration. For larger values of L/D, the projectile becomes difficult to stabilize and cannot be accommodated in conventional gun mechanisms. By comparison, conventional fired projectiles have L/D ratios of about 2–3.

Figure 10:
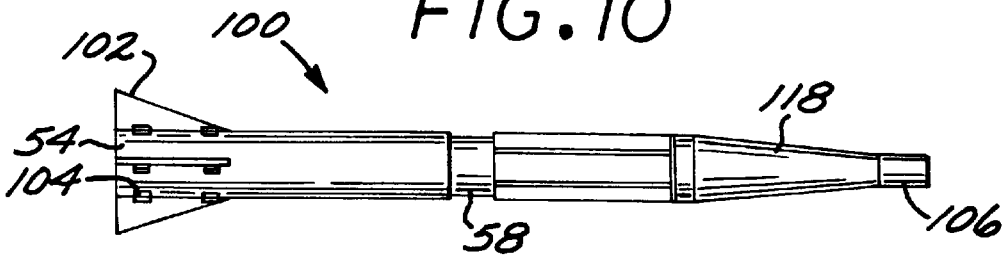
FIG. 10 is a side elevational view of a second embodiment of the projectile.
Figure 11:
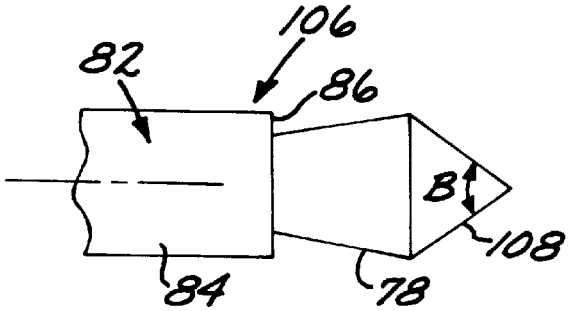
FIG. 11 is a detail of FIG. 10, illustrating an alternative embodiment of the stinger head.
Figure 12:
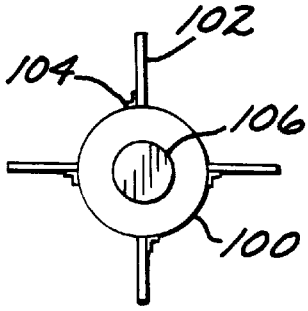
FIG. 12 is a front elevational view of the projectile of the FIG. 10.

Various modifications may be made to the projectile, as shown in FIGS. 10–12. The features of projectiles having these modifications are otherwise the same as those previously described for the projectile 50, and those descriptions are incorporated here. The features may be used in various combinations as may be appropriate.

FIGS. 10 and 12 illustrate a projectile 100 having a set of fins 102 at the rearward end 54 of the projectile. The set of fins 102 provides aerodynamic stabilization of the projectile 100 as it flies through the air. The set of fins 102 acts as a radially flared enlargement and thence performs the stabilization function against lateral displacements described earlier as the projectile 100 travels through water. If one of the set of fins 102 contacts the sides of the cavitation void 30 as a result of a lateral instability, it produces a restoring force in the manner discussed previously for the radially outwardly flared enlargement 90.

The fins 102 may extend rigidly outwardly from the body 58 of the projectile 100. Preferably, however, the fins 102 fold against the side of the projectile 100 when it is encased within the sabot 38. As the pieces 34 of the sabot fall away, the fins 102 open outwardly to the positions shown in FIGS. 10 and 12. The opening action of the fins 102 can be produced in any of several ways. In one, the fins 102 are formed of a springy metal and cantilevered from the side of the projectile. The fins are folded down to lie against the sides of the projectile when the sabot is placed around the body 58 of the projectile 100. When the pieces 34 of the sabot fly away after the projectile is fired, the fins 102 spring open. In another approach shown in FIGS. 10 and 12, the fins 102 are mounted to the body 58 of the projectile 100 by hinges 104 that operate between a closed position with the fins folded flat and an open position with the fins extended.

Another embodiment of a stinger head 106 is also shown in FIG. 10 and in greater detail in FIG. 11. The stinger head 106 is like the stinger head 74, except that a conical forward face 108 is substituted for the flat forward face 80 of FIG. 6. An included conical angle B of the conical nose 108 can be as large as about 130° while still permitting the stinger head 106 to cooperate with the flow separation groove 86 to induce the flow separation that leads to the formation of the cavitation void 30 as the projectile 100 travels through the water. The flat forward face 80 of FIG. 6 is preferred to induce the flow separation, but the use of the conical forward face 108 has the advantage that it reduces the shock loading on the projectile 100 as it enters the water at the air/water interface 28. For designs utilizing a high mass of the projectile and a propellant creating a high muzzle velocity, it may be necessary to reduce such shock loading so that the projectile does not fragment when it enters the water.

FIG. 10 also shows another embodiment of a projectile forebody 118. The projectile forebody 62 of FIG. 2 is generally conical. The projectile forebody 118 of FIG. 10 is ogival in shape. An ogive, having a shape generally describable as comprising a portion of an ellipse, is convexly curved outwardly as compared with a conical shape. The ogive permits additional mass of the projectile 100 to be concentrated toward the forward end of the projectile 100, as desired, rather than toward its rear. Ogival shapes are used in some other contexts such as some conventional bullets, missiles, and rockets for other reasons, reducing aerodynamic drag. The ogival projectile forebody 118 has little effect on aerodynamic drag as compared with the conical projectile forebody 62. Instead, as noted, its function is to increase the mass of the projectile 100, with the mass positioned near the forward end. Other shapes of the projectile forebody can also be used.

Figure 13:
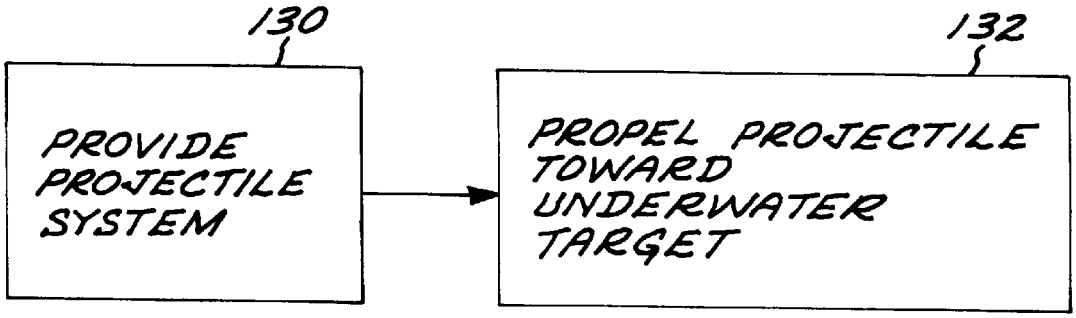
FIG. 13 is a block flow diagram of a method for damaging underwater targets.

FIG. 13 illustrates a preferred method for utilizing any of the projectiles and projectile systems made according to the present invention to damage an underwater object. A projectile system is provided, numeral 130. The projectile system is as previously described, or has a combination of the features previously described. The projectile system is propelled toward an underwater target from a location in the air, numeral 132, as illustrated in FIG. 1. The projectile travels through the air initially, passes through the air/water interface, and then travels through the water toward the target.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A projectile system comprising a generally cylindrical symmetric projectile with a projectile forward end and a projectile rearward end, the projectile having:

a stinger head at the projectile forward end, the stinger head including a stinger nose having a nose maximum diameter, and a stinger body having a stinger body forward end joined to a rearward end of the stinger nose, the stinger body including a stinger nose support having a nose support diameter, and a flow separation groove between the stinger nose support and the stinger nose, the flow separation groove having a groove diameter less than the nose maximum diameter;

a generally cylindrical symmetric projectile body joined to the stinger head, the projectile body having a projectile afterbody having a projectile afterbody diameter greater than the nose maximum diameter, wherein the projectile afterbody comprises a cylindrical central region, and a plurality of grooves in the central region, and a projectile forebody joined to the stinger nose support at a forward end and to the projectile afterbody at a rearward end; and a set of fins joined to the projectile rearward end for stabilizing the projectile against lateral instability.

2. The projectile system of claim 1, wherein each of the fins is foldable.

3. The projectile system of claim 1, wherein each of the fins is joined to the projectile body by a hinge.

4. The projectile system of claim 1, wherein the stinger nose comprises a blunt forward face.

5. The projectile system of claim 1, wherein the projectile afterbody has a radially flared enlargement at the projectile rearward end.

6. The projectile system of claim 1, wherein the stinger head is made from a material selected from the group consisting of steel and tungsten carbide.

7. The projectile system of claim 1, wherein the stinger nose comprises a conical forward face.

8. The projectile system of claim 1, wherein the projectile afterbody comprises a payload cavity, and a payload contained within the payload activity.

9. The projectile system of claim 1, wherein the projectile forebody diameter gradually decreases from the afterbody diameter at its rearward end to the nose support diameter at its forward end.

10. The projectile system of claim 1, wherein the projectile forebody is conical.

11. The projectile systems of claim 11, further comprising a discardable sabot affixed around the projectile.

12. The projectile system of claim 1, wherein the projectile body forward end forms a cavitation void which extends fully around the entire projectile body when the projectile body is passed through water such that the remainder of the projectile body is not wetted.

13. The projectile system of claim 1, wherein the projectile is fired from a gun.

14. The projectile system of claim 1, wherein the flow separation groove comprises a forwardly facing separation groove shoulder between the stinger nose and the stinger nose support.

15. The projectile system of claim 1, wherein the projectile is fired toward an underwater target from a location in air, through an air/water interface, and into water.

16. The projectile system of claim 1, wherein the projectile forebody is ogival.

17. The projectile system of claim 1, wherein the stinger nose has a surface finish of no greater than about 16 micro-inches.

18. The projectile system of claim 1, wherein at least some of the grooves extend parallel to a cylindrical axis of the projectile afterbody.

19. The projectile system of claim 1, wherein the projectile rotates during flight.

20. The projectile system of claim 1, wherein the projectile body is made, at least in part, of tungsten.

* * * * *